United States Patent [19]

Egender

[11] Patent Number: 4,837,957

[45] Date of Patent: Jun. 13, 1989

[54] DIGITAL NUMBER INDICATOR

[75] Inventor: James J. Egender, Kansas City, Mo.

[73] Assignee: Dial-A-Down, Inc., Kansas City, Mo.

[21] Appl. No.: 77,224

[22] Filed: Jul. 24, 1987

[51] Int. Cl.[4] ..... G09F 7/00

[52] U.S. Cl. ..... 40/488; 40/491; 40/598

[58] Field of Search ..... 40/488, 591, 598, 508, 40/476

[56] References Cited

U.S. PATENT DOCUMENTS

| | | | |
|---|---|---|---|
| 1,573,344 | 2/1926 | Jordan | 40/488 |
| 2,117,187 | 5/1938 | MacLaren | 40/488 |
| 2,799,105 | 7/1957 | Tilley | 40/488 |
| 2,833,066 | 5/1958 | Morrissey | 40/488 |

*Primary Examiner*—Gene Mancene
*Assistant Examiner*—Wenceslao J. Contreras
*Attorney, Agent, or Firm*—Litman McMahon & Brown

[57] ABSTRACT

A numerical display especially for use as a down marker in football games. The numbers which are displayed are painted on sets of slats which slide up and down by operation of finger levers connected to the slats by a special linkage. The slats slide behind other slats in a concealed position and are visible in an exposed position through transparent windows of a padded housing which encloses the operating components. A frictional detent retains the levers in place to prevent inadvertent slipping of the number which is displayed.

21 Claims, 3 Drawing Sheets

DIGITAL NUMBER INDICATOR

BACKGROUND AND SUMMARY OF THE INVENTION

This invention relates in general to a digital number indicator and more particularly to an apparatus having a mechanism for displaying a plurality of numbers, individually, housed in a transparent housing that is protected by an outer padding.

In a wide variety of situations it is necessary to display numbers. For example, in the retail business it is important to display prices, while various sports require numbers to be kept track of and displayed. In basketball, it is especially important to keep track of and display the number of fouls of each player. In baseball, it is important to keep track of and display the balls, strikes and outs as well as the runs of the game. In each of these sports, the numbers are typically displayed on an electronic scoreboard that is visible to everyone, including spectators and participants. There is no need to have these numbers immediately displayed on the playing surface and certainly not so that it could interfere with the play of the game.

Football presents a similar yet distinct problem. In football, an important event that must consistently be visible to players, officials, and spectators is what down it is. Although the current down is often kept on an electronic scoreboard, it is also necessary for the down to be maintained on the field along the sidelines at a location visible to the players and officials. Not only must the players and officials be able to quickly see what down it is by referring to the down marker on the field, in many situations, especially high school and junior football, the down marker on the field may be the only indicator of the downs for the spectator.

Currently, the type of numerical down marker that is used throughout all levels of football consists of a flip card device mounted on a stake. This flip card device normally consists of a set of four cards. Each card has a single number painted thereon (either 1, 2, 3 and 4), and the cards are joined together by two rings so that the cards can be flipped forward or backward to display the proper down. One of the problems with this type of down marker is that it is hazardous to the players in the game. The individual cards have sharp edges and are in no way provided with any protective padding. Since the down marker must be kept on the sidelines of the playing field at the line of scrimmage, a player will often run into, or be tackled into, the down marker. This can cause serious injuries to the players and to others in the immediate vicinity. An increasing number of players are injured in football, and any form of safety or protection to the player is desirous and needed for the game.

Another problem with the flip card device is that the rings on which the numbers are mounted are easily broken. When a ring breaks or when a number breaks off of the ring, the number becomes crooked and difficult for the players, officials and spectators to see. The flip card device is also bulky and slow to operate.

As previously mentioned, it is possible to display numbers, such as prices in the retail situation or downs in the game of football, by means of an electronic number indicator. However, an electronic device to display numbers is often too expensive to be practical in many applications. The cost of continuously running an electric price board in a retail store would be prohibitive in most cases. In many sports, and especially in football, it is impractical to use an electronic number device as a sideline down marker, particularly in high school and junior league football. Providing an AC operated device would be impractical if not impossible, and it would also be costly and impractical to employ a battery operated device.

Thus, there is a need for a non-electric, safe, economical, easy to operate, and practical digital number indicator. A compact device that could incorporate these advantages would be of utility in a wide variety of situations where a plurality of numbers or letters, either individually or in predetermined groups, must be displayed. There is a special need in the sport of football for a down marker that is not hazardous or injurious to the players and is also dependable, easily visible, compact, easy to operate, portable and safe. It is one of the important goals of the present invention to provide such a digital down marker.

It is a general object of this invention to provide a digital number indicator that is useful in a wide variety of settings and applications.

It is another object of this invention to provide a digital number indicator that exhibits safety, practicability and economy.

It is another object of this invention to provide a digital number indicator wherein the numbers can be changed quickly and easily through the use of a lever system.

It is a further object of this invention to provide a digital number indicator especially adapted to indicate the downs of a football game that is encased in a padded housing to prevent any injuries being caused by the down marker.

It is a still further object of this invention to provide a digital number indicator that is easily visible and dependable.

It is still another object of this invention to provide a digital number indicator especially adapted for use in football wherein the numbers 1 through 4 are fluorescently painted of an optimum size for maximum visibility.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT

Figures 1, 2, 3:
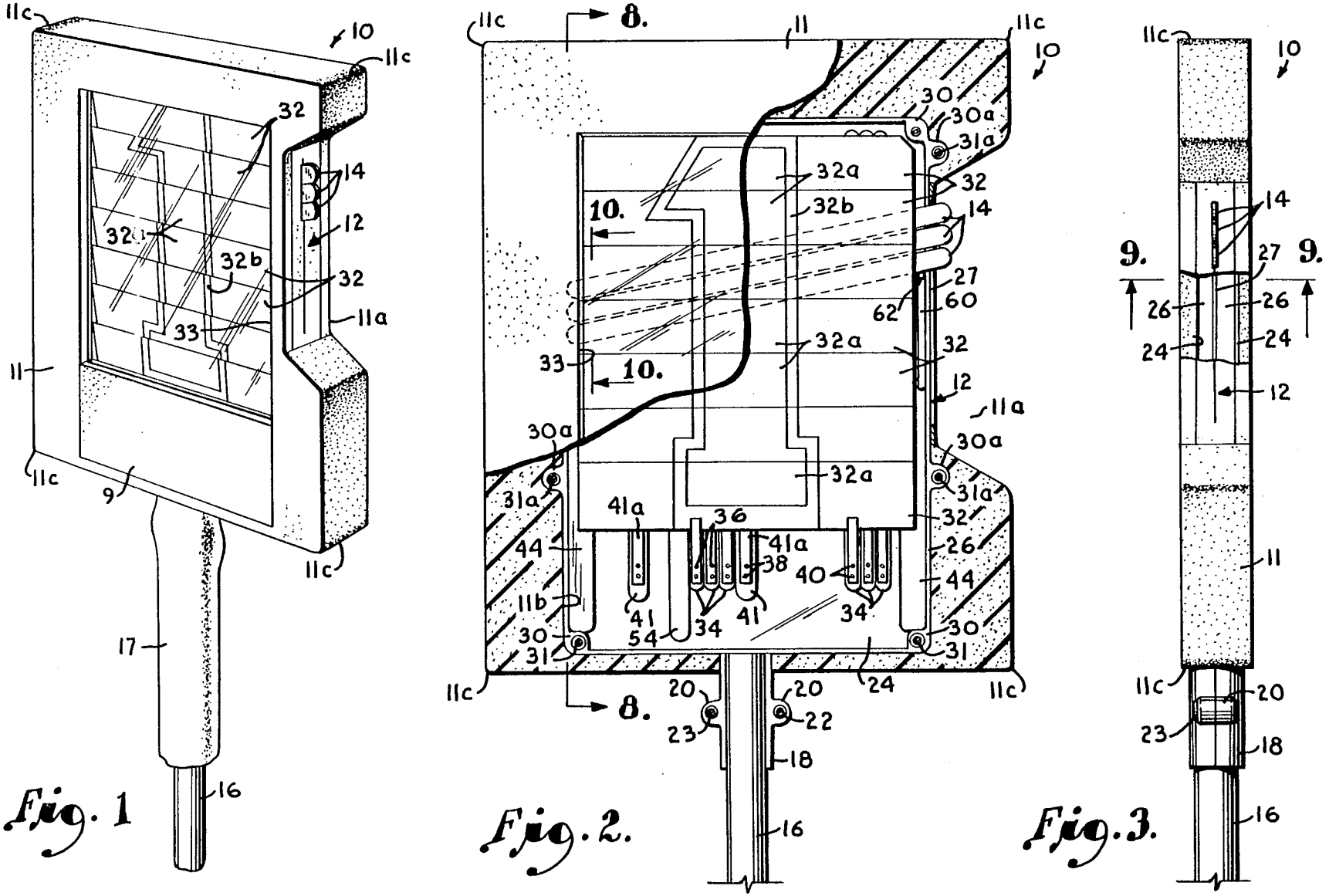
FIG. 1 is a perspective view of a digital down marker constructed according to a preferred embodiment of the present invention.
FIG. 2 is a front elevational view of the down marker, with portions broken away to illustrate the internal parts.
FIG. 3 is a side elevational view of the down marker with a portion broken away for purposes of illustration.

Referring initially to FIG. 1, a light weight digital number indicator designed to be used as a down marker for football is designated generally by the numeral 10. Down marker 10 has an exterior padding 11 made of a soft protective material. Padding 11 surrounds the perimeter of a generally rectangular housing 12. The protective padding 11 surrounding the housing 12 of the down marker 10 is cut away on one side at 11*a* so projecting ends of three levers 14 are accessible to the operator of the device. Along the inside of padding 11 a channel 11*b* (See FIGS. 2 and 4) is grooved into the padding so that the padding 11 fits around housing 12. Each of the four corners 11*c* of the padding 11 is rounded to avoid presenting any sharp edges or corners on the exterior of the device. Additional pieces of protective padding 9 are affixed by glue or other suitable fastening means to a bottom portion of housing 12 on opposite sides of the housing to conceal the inner mechanism of the device and to further pad the housing. The down marker 10 can be mounted on a pole or stake 16 that can also be covered with a protective padding 17 (FIG. 1) conformed to fit the pole.

Figure 8:
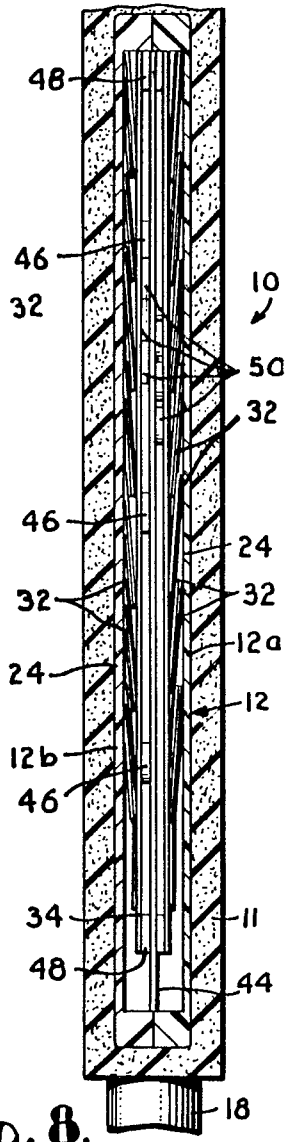
FIG. 8 is a sectional view taken generally along line 8—8 of FIG. 2 in the direction of the arrows.

The housing 12 is generally rectangular and is composed of two identical halves 12*a* and 12*b*, as best shown in FIG. 8. The housing 12 is constructed of a transparent material having sufficient strength to withstand the impact of a collision. The housing in a preferred embodiment of this invention is molded from a polycarbonate material. This clear polycarbonate housing 12 can be coated with a non-glare substance to prevent undue glare caused by reflection of the sun or lights. The two halves 12*a* and 12*b* of housing 12 cooperate to provide a downwardly projecting cylindrical neck 18 presenting rounded protuberances or lugs 20 on either side. These protuberances 20 have an opening 22 through them for accepting a two-piece fastener, such as a threaded barrel and screw 23 (FIG. 4) for tightening the housing to pole 16. Each half of the housing 12 has a generally flat panel 24 and flanged margins 26 extending around the perimeter of the panel. One of the margins 26 of one half of housing 12 has a slot 27 (FIG. 9) cut through the margin so that when the two halves of the housing are joined together, lever arms 14 extend outside of the housing 12 through the slot 27 to make the lever ends accessible.

Figure 4:
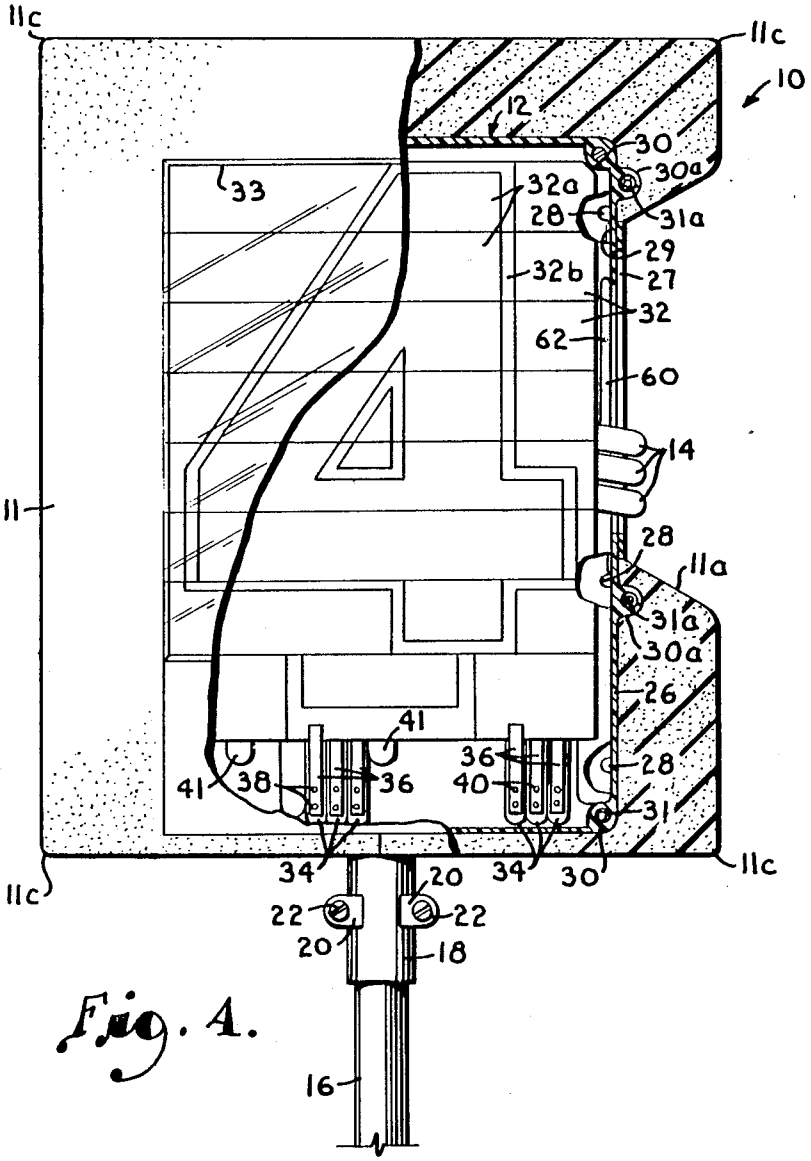
FIG. 4 is a front elevational view of the down marker, with portions broken away to illustrate the internal parts.

As can be seen in FIG. 4, semicylindrical bosses 28 are formed on the insides of the margins 26 of housing 12 near the top, the bottom, and the middle of the housing 12. A ledge 29 is integrally molded into one of the side margins of housing 12, and runs between the top and middle bosses 28. The ledge 29 supports a framework which is generally identified by numeral 42. Ledge 29 has a groove positioned where the levers 14 are connected to the framework, and the ends of the levers 14 contact ledge 29 such that pressure is exerted on the lever ends to assist in maintaining the placement of the levers 14.

Referring again to FIGS. 2 and 4 in particular, the four inside corners of each half 12*a* and 12*b* of housing 12, are provided with bosses 30 which present openings 31. Outwardly projecting lugs 30*a* are formed on the margins 26 and provided with openings 31*a*. The bosses 30 and lugs 30*a* align with one another and receive suitable fasteners for securing the two halves of the housing together. A rectangular cavity which houses the working mechanism of the down marker is presented between the panels 24 and within the margins 26.

Referring now to FIGS. 2 and 4, in particular, a plurality of horizontal slats 32 are arranged in four different sets which display four different numerals corresponding to the four permissible downs in a football game. Thus, each set of slats displays one of the numerals 1 through 4. The display numerals are located behind and are visible through rectangular windows 33 on opposite sides of the housing. Each individual slat 32 of a particular set of slats has a portion 32*a* of the corresponding numeral thereon, and when the slats are exposed, the portions 32*a* cooperate to display the corresponding numeral 1–4. A contrasting border 32*b* may extend around each display numeral to separate it from the background. The numerals can be applied to the slats 32 in any suitable manner. A preferred embodiment of this invention has fluorescently colored numerals against a contrasting background which occupies the remainder of the slat. The numerals are preferably painted on, but can be affixed by other methods.

A special coating 33*a* (FIG. 2) is preferably applied to both of the windows 33 in order to reduce glare and thus enhance the visibility of the display. In FIG. 2, the set of slats 32 that presents the numeral 1 is visible and the numeral 1 is thus displayed. FIG. 4 shows the position in which the set of slats 32 that presents the numeral 4 is visible. Each set of slats 32 is presented in a louvre type arrangement in which the upper edge of each slat 32 overlaps the lower part of the slat immediately above. The slats 32 for each numeral are arranged to slide behind and be covered by the set of slats 32 for the next higher numeral. This creates adjacent rows of individual slats 32 in which the slats for each numeral may be positioned behind the slats relating to other numerals. The outermost slat 32 in each row of slats is the only slat that is visible at a given time, and the remaining slats in the row are positioned behind and are concealed by the slat which is visible in the row.

The individual slats 32 in each set for the numerals 1–3 are connected to stringers 34 by means of tabs 36. Each stringer 34 presents raised bosses 38 that extend through openings 40 in each tab 36. These bosses can be melted to securely affix the tab to the stringer. Each tab 36 is secured at the other end to one of the slats 32. This can also be done by a heat stamp method.

An alternative embodiment (not shown) has the tabs 36 integral with slats 32. Any means of joining the tabs to the stringers can be employed. In any event, each set of slats 32 for the numerals 1–3 is connected to a pair of spaced apart stringers 34 so that the slats move up and down when the corresponding stringers slide up and down, as will be explained more fully.

The slats 32 which display the numeral 4 are connected to a pair of stationary stringers 41 which are parallel to stringers 34 and to one another. The slats for numeral 4 are connected with the stationary stringers 41 by tabs 41*a* in the same manner described for the other stringers.

It is noted that each numeral is displayed through both windows 33 on the opposite sides of the housing 12 by two identical sets of slats 32 mounted on opposite sides of the stringers 34 and 41. In other words, each set of slats has a counterpart set of slats which faces in the opposite direction in order to provide the same number display on both sides of the device. A set of slats 32 corresponding to each numeral is coupled to both sides of the stringers 34 and 41 so that each numeral that is displayed is visible simultaneously on and from both sides of the housing through the windows 33. In the down marker 10, as shown in the preferred embodiment, there are three pairs of stringers 34, one pair for each numeral 1–3. The two stringers 41 for the slats that display the numeral 4 are stationary, while the pair of stringers 34 for the other three numerals are supported in the housing to slide up and down between the positions shown in FIGS. 2 and 4.

Figure 5:
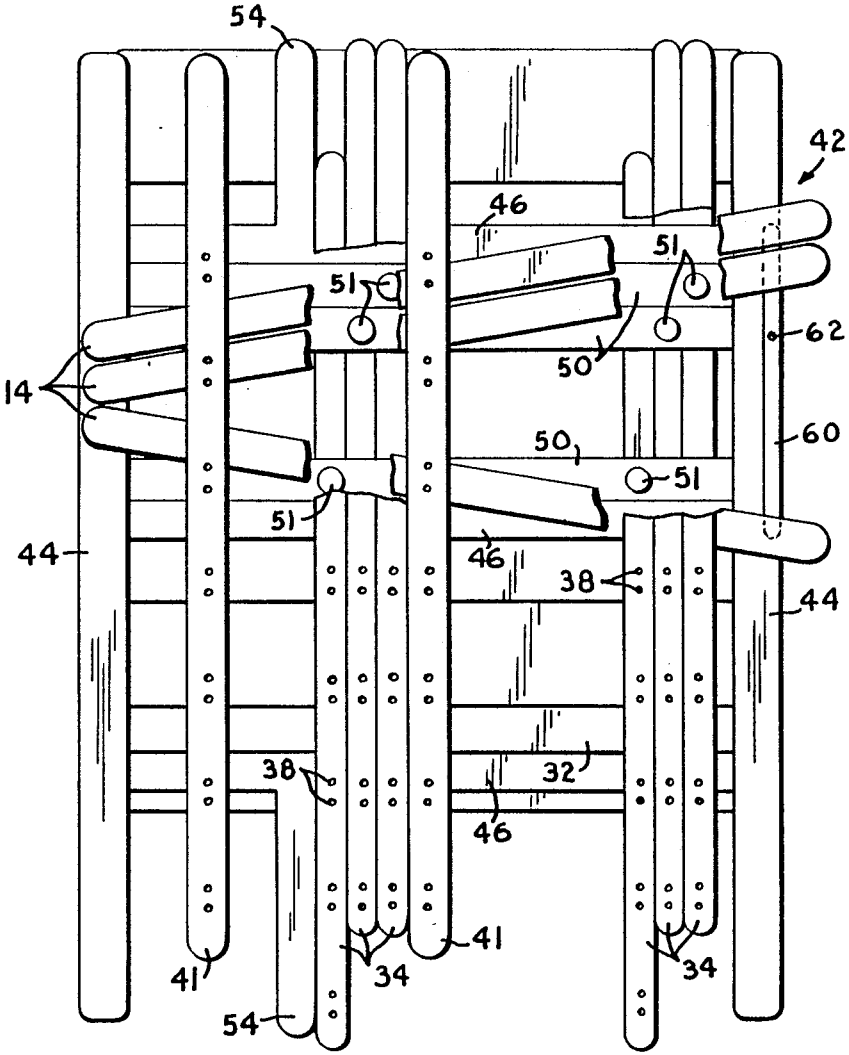
FIG. 5 is a front elevational view of the internal mechanism of the down marker with the number slats removed from one side and portions broken away for purposes of illustration.

The framework 42 of the mechanism for changing the numbers is best shown in FIG. 5 and includes a pair of vertical bars 44 that extend the approximate height of the housing along opposite sides and three horizontal bars 46 that approximately span the width of housing 12. These bars 46 extend rigidly between bars 44 near the tops, centers and near the bottoms of the vertical bars 44. The bars 44 and 46 cooperate to provide a rigid framework along which the moving parts travel as the mechanism is operated. As can be seen in FIG. 5, the stringers 34 and 41 are generally vertical and are generally parallel to the vertical support members 44 of the framework 42.

Figure 6:
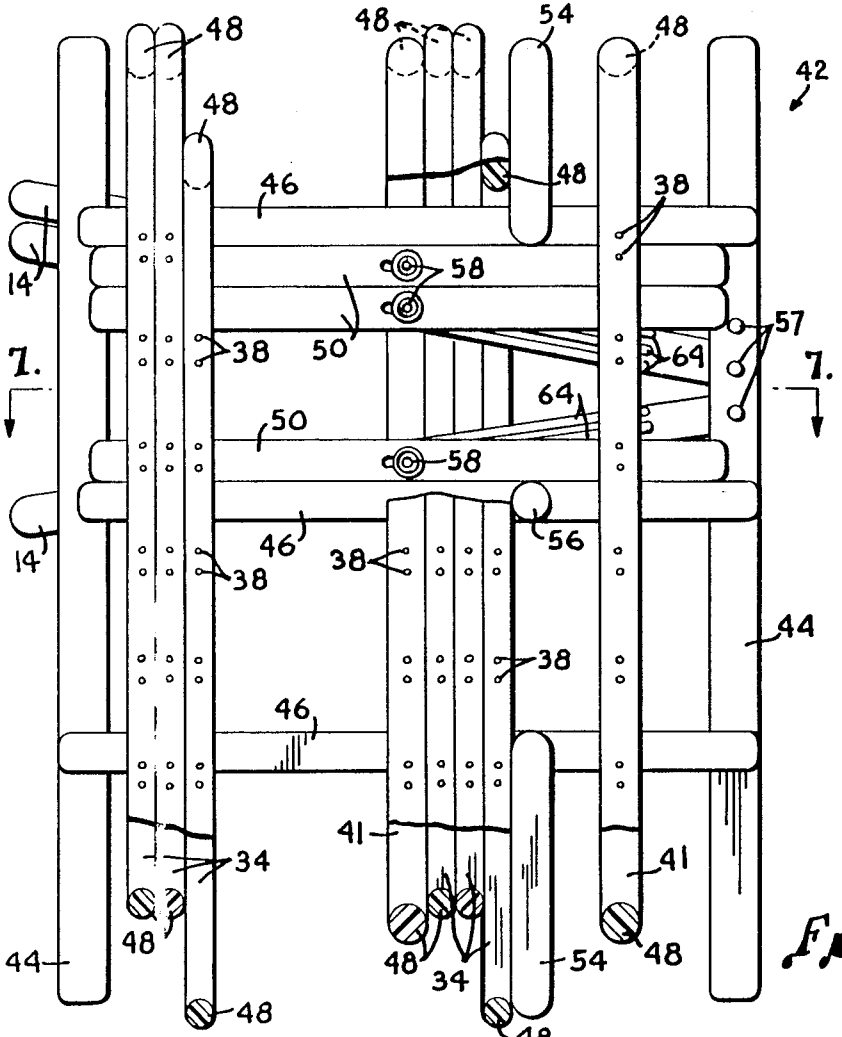
FIG. 6 is a rear elevational view of the internal mechanism of the down marker with all of the slats removed and portions broken away for purposes of illustration.
Figure 7:
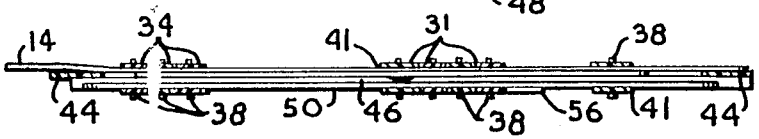
FIG. 7 is a sectional view taken generally along line 7—7 of FIG. 6 in the direction of the arrows.

As best shown in FIG. 7, each stringer 34 and 41 includes two spaced apart rails that are connected at the top and bottom by bosses 48 (See FIG. 6). One of the rails of each stringer 34 and 41 is positioned on one side of the horizontal bars 46 and the other rail is on the opposite side of the horizontal bars 46. The rails of each stringer thus bracket bars 46. The stringers 41 that carry the set of slats for the numeral 4 are secured to the top and bottom bars 46 of framework 42.

Positioned between the top and middle bars 46 of the framework are three slidable horizontal arms 50 disposed one above the other and overlapping bars 44 at their opposite ends. The lower most arm 50 is rigidly connected with the two stringers 34 associated with the display numeral 1. The center arm 50 is likewise connected with the two stringers for the numeral 2, while the upper arm 50 is connected with the two stringers for numeral 3. The connections between arms 50 and stringers 34 are made at locations 51 (FIG. 5) and may be heat sealed connections. The connections of each arm 50 with a pair of the stringers causes the stringers in each pair to slide up and down in response to up and down movement of the arms 50.

The upper and lower arms 50 are limited in their travel by engagement with the adjacent arm and the upper or center bar 46. The middle arm 50 has the same allowable travel limited by its engagement with the arms 50 above and below it. The travel of each arm is a distance equal to the height of each slat 32 so that when each arm 50 moves downwardly, its slats 32 slide behind those of the immediately lower display numeral. Conversely, upward movement of each arm 50 carries its slats out from behind the other slats to an exposed location.

As best shown in FIG. 6, rigidly attached to the top and bottom horizontal bars 46 are two stationary guides 54. Mounted on the middle bar 46 is a circular guide 56 which cooperates with guides 54 and one of the stationary stringers 41 to maintain the alignment of the slidable stringers 34. One stringer 34 in each pair is held side by side with the other stringers between stringer 41 on one side and guides 54 and 56 on the other side. In this manner, stringers 34 are prevented from moving side to side or becoming skewed and are restricted to only up and down sliding movement.

The three levers 14 allow the arms 50 and attached stringers 34 to be moved up and down to change the numeral which is displayed. Levers 14 are positioned one above the other, and the end of each lever 14 opposite the projecting end is pivoted at 57 (FIG. 6) to one of the vertical bars 44. The uppermost lever 14 is pivoted near its midpoint to the center of the top bar 50. The center lever 14 is similarly pivoted to the center bar 50, while the lowest lever 14 is pivoted to the lower bar 50. Suitable fasteners 58 (FIG. 6) are used to make the pivotal connections between levers 14 and bars 50. The connection of each lever 14 to bar 44 at one end and to arm 50 at its center results in each arm 50 being moved up and down when the corresponding lever 14 is pivoted up and down about pivot coupling 58.

Figure 10:
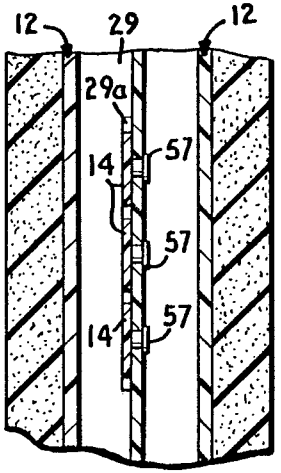
FIG. 10 is a fragmentary cross-sectional view taken generally along line 10—10 of FIG. 2 in the direction of the arrows.

As shown in FIGS. 6 and 10, should any one of the levers 14 become inadvertantly disengaged from bar 44, the disengaged lever would then drop within an indentation **29*a* in the cooperating ledge 29 within the assembled housing 12. The lower surface 29*b* of the indentation 29*a*** precludes the levers from dropping below an operable position thusly insuring that the unit will continue to function.

Figure 9:
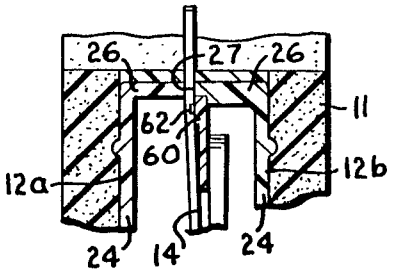
FIG. 9 is a fragmentary cross-sectional view taken generally along line 9—9 of FIG. 3 in the direction of the arrows.

A detent arrangement is provided to hold the levers 14 up and prevent them from inadvertently falling to possibly change the display number at an inopportune time. As best shown in FIGS. 5 and 9, one of the vertical bars 44 is provided with a raised ridge 60 which extends generally along and adjacent to the slot 27 that receives levers 14. The end portion of each lever 14 is curved or bowed somewhat toward the ridge 60 such that the bow causes the lever to push against the surface of the ridge while fitting snugly through the slot 27 in the housing. Consequently, friction between the bowed portions of levers 14 and ridge 60 retains each lever in the position to which it is moved, and accidental movement of the lever under the influence of gravity or other forces is prevented.

In addition, a small button 62 projects from the surface of ridge 60 at a location to engage the lowermost lever 14 when this lever is in its "up" position (i.e., when "first" down is being displayed). Button 62 thus exerts added frictional force against the lever 14 to even more securely hold it in place in order to overcome the weight of all three levers 14 which tends to cause dropping of the levers. The levers 14 may be ribbed at 64 (FIG. 6) to enhance their stiffness and strength without making them unduly bulky.

Each set of slats 32 preferably includes seven individual slats arranged one above the other. The size of each numeral must be such that it is easily visible to players, officials and spectators, yet it cannot be so large as to obstruct the view of spectators. A larger numeral and thereby a larger device may be easier to see, but creates other problems such as obstructing the view of spectators, becoming too bulky and unable to be quickly and easily moved, or, when used outside, being exposed to so much wind force that it becomes extremely difficult to hold upright and otherwise handle. Because of these problems, the size of the numeral and the corresponding housing and inner mechanism of the device has an optimum range of utility for visibility, mobility and resistance to wind. This optimum range is where the height of each numeral is between 8 and 17 inches. This size range has all of the necessary features to provide a useful number indicator for football, and it is thus preferred that the height of each numeral be between 8 and 17 inches.

In operation, the down marker 10 serves to display the number of the upcoming down for the offensive team in a football game. When all of the lever arms 14 are raised and in the "up" position, the numeral 1 will be visible through the windows 33 on the opposite sides of housing 12, since the slats 32 which display the numeral 1 are then exposed. When the lowermost lever arm 14 is lowered, the corresponding bar 50 and stringers 34 lowered, and the set of slats 32 relating to numeral 1 slide down one row each and become concealed behind the slats 32 for the numeral 2, and numeral 2 is then displayed in windows 33. The bottom slat 32 for the numeral numeral 1 slides down into a new bottom row of slats 32 which is located below windows 33 and thus concealed by the padding pieces 9. The corresponding bottom slats 32 of the other sets of slats 32 subsequently slide behind the hidden bottom slat for numeral 1. When the second lever arm 14 is lowered, the set of slats 32 which displays the numeral 2 moves down one row and behind the slats 32 for the numeral 1. Numeral 3 is then presented in the windows 33. Similarly, when the uppermost lever arm 14 is lowered, the set of slats 32 relating to the numeral 3 will move down one row of slats 32 and slide behind that next lower row of slats 32, thereby exposing the set of slats 32 corresponding to the numeral 4. This process may be reversed in sequential order to display each individual numeral, or, more commonly, all three lever arms 14 may be raised simultaneously to again show the numeral 1 when a first down has been made. As each lever arm 14 is lowered, only one pair of stringers 34 will move downward. Thus, when the numeral 1 is being shown all the lever arms 14 are in the "up" position and all of the stringers 34 are correspondingly in the "up" position. When the numeral 4 is shown, all of the lever arms 14 are in the "down" position and all of the stringers 34 are in the corresponding "down" position.

As previously indicated, the levers 14 extend out of the housing 12 so that they are accessible for changing of the down number. The bowed end portions of the arms, in cooperation with the raised ridge 60 and the button 62, provides a frictional detent arrangement that prevents levers 14 from slipping out of place. However, the levers can be moved as desired by hand when the down number is to be changed.

It can thus be seen that the present invention provides a digital number indicator, especially suitable for use as a football down marker, that is efficient, durable, quick, easy to operate, dependable and fully enclosed to protect the internal components from the elements and from external forces that could damage them. The padding 11 assures that injuries to players and others will not occur in the event that the down marker is involved in a collision along the sideline. The numerals which are displaced through the windows 33 are readily visible from both sides of the housing to the participants on the field and on the sidelines, as well as to spectators. Preferably, a suitable glare reducing coating is applied to the surfaces of the windows to avoid excessive glare that could otherwise detract from the visibility of the numbers.

Although the invention has been described in connection with, and is especially well suited for use as, a down marker, it is noted that the device can also be used in a wide variety of situations involving a need to display numbers and/or letters.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A display device for visually displaying a plurality of different numbers, said device comprising:

a display housing presenting a substantially enclosed interior and a transparent display window;

at least four sets of slats located within the housing; each set including a plurality of slats cooperating with the other slats in a respective set to display a different number than is associated with the slats in each of the other sets located in the housing for display in said display window; each of said sets of slats being movable between an exposed position wherein the slats of one of said sets are visible through said window and a concealed position wherein the respective slats are hidden;

a plurality of operating levers each having an end accessible outside of said housing, each of said levers being mounted in the housing for generally up and down movement of said accessible end of the lever;

linkage means for coupling each lever with a corresonding set of slats in a manner to effect movement of the corresponding set of slats between the exposed and concealed positions thereof in response to generally up and down movement of said accessible end associated with the corresponding lever; said operating levers and said linkage means cooperating so as to allow an operator to select to expose any one of said sets of slats with each subsequent single movement of an operating lever by the operator such that any one of at least four numbers can be selected by the operators;

a frictional detent surface on the housing at a location to align with said accessible ends of the levers when the lever ends are in preselected positions; and said accessible ends of the levers being bowed generally toward said detent surface to frictionally engage same in said preselected positions of the levers to thereby frictionally retain the levers in said preselected positions.

2. The device of claim 1, including a button projecting from said detent surface at a location to engage one of said levers when said one lever is in said preselected position thereof, thereby assisting in the retention of said one lever in said preselected position thereof.

3. The device of claim 1, including soft padding covering said housing but leaving said windows exposed.

4. The device of claim 1, including a glare reducing coating on said window.

5. The device of claim 1, wherein:

each slat in each set of slats bears a portion of the number which is displaced by the set; and said portions are formed by fluorescent paint applied to the slats.

6. The device of claim 1, wherein said linkage means comprises:

a rigid framework mounted in said housing in the interior thereof;

a pair of parallel stringers for each set of slats mounted on said framework for linear movement between limiting positions and carrying the slats in the corresponding set between the exposed and concealed positions when the stringers are moved to the limiting positions; and means for coupling said levers to the pairs of stringers for the corresponding sets of slats in a manner to move the stringers to the limiting positions in response to up and down movement of the accessible ends of the corresponding levers.

7. The device of claim 6, wherein said coupling means comprises:

a rigid horizontal arm for each pair of stringers connected to both stringers in the pair in a manner to move the stringers up and down when the arm is moved up and down;

means for pivotally coupling with the framework an end of each lever opposite the accessible end thereof; and means for pivotally coupling each lever to the corresponding arm at a location offset from said opposite end.

8. A number indicator for alternately displaying different numbers, comprising:

a display housing having a substantially enclosed interior and a transparent display window;

a rigid framework mounted in said housing;

at least four sets of slats located in said housing such that at least one of said sets is visible in said display window; each set including a plurality of slats arranged one above the other generally edge to edge, the slats in each respective set cooperating to visually display a number different from the numbers displayed by the slats of the other sets;

a pair of stringers for each set of slats, each pair of stringers being mounted on said framework parallel to one another for generally up and down linear movement along a prescribed path, each slat in each set of slats being connected at spaced apart locations to both stringers in the corresponding pair to carry the slats up and down with the stringers;

means for restricting said stringers to linear movement along said path;

a generally horizontal arm for each pair of stringers extending between and interconnecting the corresponding stringers;

a plurality of operating levers each having opposite first and second ends, said first end of each of said levers being accessible outside of the housing and said second ends being pivotally coupled to said framework, each lever being coupled at a location between said ends thereof with a respective arm at a location thereon between the stringers connected by the arm, whereby up and down movement of said first end of each lever moves the corresponding arm and stringers up and down to carry the corresponding slats up and down; and each set of slats having an exposed position at one limiting position of the corresponding lever wherein the slats of such a set are exposed through the window and a concealed position at another limiting position of the corresponding lever wherein the slats are concealed by slats in another set of slats.

9. The number indicator of claim 8, including detent means for retaining each lever at a preselected position.

10. The number indicator of claim 8, including soft padding substantially surrounding said housing but leaving said window exposed.

11. The device of claim 8, including a glare reducing coating on said window.

12. The device of claim 8, wherein:

each slat in each set of slats bears a portion of the number which is displayed by the set; and said portions are formed by fluorescent paint applied to the slats.

13. A down marker for displaying the number of an upcoming down in a football game, said down marker comprising:

a display housing having a substantially enclosed interior and generally flat opposite sides;

a transparent window on each of said sides;

soft padding substantially covering said housing but leaving both windows exposed;

a pole with said housing mounted thereon;

a pair of opposed visual displays comprising the individual numerals 1, 2, 3 and 4 for each possible down in the football game mounted in the housing at locations facing away from each other and adjacent the respective windows, each display bearing the number of the corresponding down and being visible through the window;

a plurality of horizontal slats arranged in sets wherein each set of said slats includes thereon one of said numerals and there being at least four sets in each display; said slats of each set when displaying a respective numeral being aligned generally edge to edge one above the other; the slats in each display being mounted for movement in tandem with the slats in the opposing display between said exposed position of a particular numeral and a concealed position of a particular numeral wherein the is concealed; and lever means accessible from the exterior of said housing for effecting movement of each pair of opposing displays selectively such that a particular numeral is moved between the concealed and exposed positions thereof, such that the number for each possible down can be selectively displayed in both windows simultaneously and wherein said lever means cooperates with said slats to allow an operator to directly move from displaying one numeral to allowing display of any of the other numerals.

14. The down marker of claim 13, including a glare reducing coating on each window.

15. The down marker of claim 13, including:

a rigid framework mounted in said housing;

a pair of parallel stringers for each pair of displays, at least some of said pairs of stringers having movable stringers;

means for mounting said movable stringers on said framework for generally up and down movement thereon;

means for connecting each slat to both stringers in the pair of stringers corresponding to the display for the slat, whereby the slats are carried up and down by the stringers; and means for coupling said lever means to the movable stringers to move the displays between the exposed and concealed positions upon operation of the lever means.

16. The down marker of claim 15, wherein said lever means comprises a pivotal lever for each pair of movable stringers, each lever having an operating end accessible from the outside of the housing for manual operation of the lever.

17. The down marker of claim 16, wherein said coupling means comprises:

means for pivotally coupling each lever with said framework adjacent an end of the lever opposite said operating end; and means for coupling each lever with the corresponding stringers at a location on the lever between said operating end and said opposite end thereof, whereby up and down movement of said operating ends effects up and down movement of the corresponding stringers.

18. The down marker of claim 17, including a substantially horizontal arm for each pair of movable stringers extending between and interconnecting the stringers and mounted on said framework for up and down movement to carry the stringers therewith, said means for coupling each lever with the corresponding stringers comprising means for coupling each lever with the arm which extends between the corresponding stringers at a location on the arm substantially midway between the stringers.

19. The down marker of claim 16, including frictional detent means for retaining each lever in a preselected position.

20. The down marker of claim 13, wherein:

the number which each display bears is located partially on each slat which provides the display on a preselected portion of the slat; and said preselected portion of each slat is painted with a fluorescent paint.

21. The invention as in claim 13, including means for supporting the lever means in an operable position should the lever means ever become inadvertently disengaged within said housing.

* * * * *

UNITED STATES PATENT AND TRADEMARK OFFICE

CERTIFICATE OF CORRECTION

PATENT NO. : 4,837,957
DATED : June 13, 1989
INVENTOR(S) : James J. Egender

It is certified that error appears in the above-identified patent and that said Letters Patent is hereby corrected as shown below:

Title page,
Item [75], Inventor:, immediately following "John J. Egender, Kansas City, Mo." please add the following inventor -- Robert Lee Smith, Kansas City, Mo. --;
Item [19], should read -- Egender, et al. --; and
Item [22], insert -- (under 1.47) --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*